US009010037B1

(12) United States Patent
Gonzalez et al.

(10) Patent No.: US 9,010,037 B1
(45) Date of Patent: Apr. 21, 2015

(54) INTERMODAL CONCRETE BUILDING UNIT

(71) Applicants: Alfredo I. Gonzalez, Palmetto Bay, FL (US); Roberto De Leo-Mariti, Miami, FL (US); Francisco Fernandez-Galan, Palmetto Bay, FL (US)

(72) Inventors: Alfredo I. Gonzalez, Palmetto Bay, FL (US); Roberto De Leo-Mariti, Miami, FL (US); Francisco Fernandez-Galan, Palmetto Bay, FL (US)

( * ) Notice: Subject to any disclaimer, the term of this patent is extended or adjusted under 35 U.S.C. 154(b) by 0 days.

(21) Appl. No.: 14/156,662

(22) Filed: Jan. 16, 2014

(51) Int. Cl.

| | |
|---|---|
| ***E04G 21/14*** | (2006.01) |
| ***E02D 35/00*** | (2006.01) |
| ***E04H 12/34*** | (2006.01) |
| ***B28B 23/00*** | (2006.01) |

(52) U.S. Cl.
CPC ..... *E04G 21/147* (2013.01); *B28B 23/005* (2013.01)

(58) Field of Classification Search
CPC . E04G 21/142; E04G 21/147; E04B 1/34823; E04B 1/3483
USPC ..... 52/125.2–125.5, 79.9, 79.11–79.13
See application file for complete search history.

(56) References Cited

U.S. PATENT DOCUMENTS

| | | | | |
|---|---|---|---|---|
| 3,382,625 | A * | 5/1968 | Kuss | 52/63 |
| 3,742,660 | A * | 7/1973 | Bierweiler | 52/79.13 |
| 5,193,325 | A * | 3/1993 | Allison | 52/745.02 |
| 5,257,440 | A * | 11/1993 | Bardou et al. | 24/287 |
| 5,661,930 | A * | 9/1997 | Porter | 52/64 |
| 2004/0262305 | A1 * | 12/2004 | Myers | 220/1.5 |
| 2005/0084324 | A1 * | 4/2005 | Dubensky et al. | 403/305 |
| 2011/0016802 | A1 * | 1/2011 | Wallance | 52/79.9 |

* cited by examiner

*Primary Examiner* — Brian Glessner
*Assistant Examiner* — Brian D Mattei
(74) *Attorney, Agent, or Firm* — Christian Sanchelima; Jesus Sanchelima

(57) ABSTRACT

A concrete intermodal building unit for a prefabricated building structure including corner castings attached to contiguous rebars defining each corner of the concrete building unit. The corner castings can be mounted to the concrete building unit using solder, attachment plates for reinforcement, or rebar housings that connect the structural frame of the concrete building unit to the corner casting. Optionally, the corner castings can be mounted to the structural frame using I-beams.

3 Claims, 8 Drawing Sheets

INTERMODAL CONCRETE BUILDING UNIT

BACKGROUND OF THE INVENTION

1. Field of the Invention

The present invention relates to concrete building units and, more particularly, to intermodal concrete building units.

2. Description of the Related Art

Several designs for shipping containers and building units have been designed in the past. None of them, however, include an intermodal concrete building unit that can be readily mounted to other concrete building units that are compatible with worldwide logistical equipment (cranes, trucks, ships, and trains) that transport steel containers. The concrete units subject of the present application behave, in all material ways, as if they were conventional steel containers and thus enjoying the volumetric and manipulation benefits of the latter.

SUMMARY OF THE INVENTION

It is one of the main objects of the present invention to provide a concrete building unit that is compatible with the worldwide conventional logistical equipment in use today to transport and store steel containers.

It is another object of this invention to provide such a building unit made of concrete to benefit from its construction advantages such as greater durability, enhanced insulation, non-corrosiveness, fire-resistance, recyclability, versatility, mold-resistance, affordability, and prevalence in commercial and residential construction structures.

It is yet another object of this invention to provide such a building unit that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
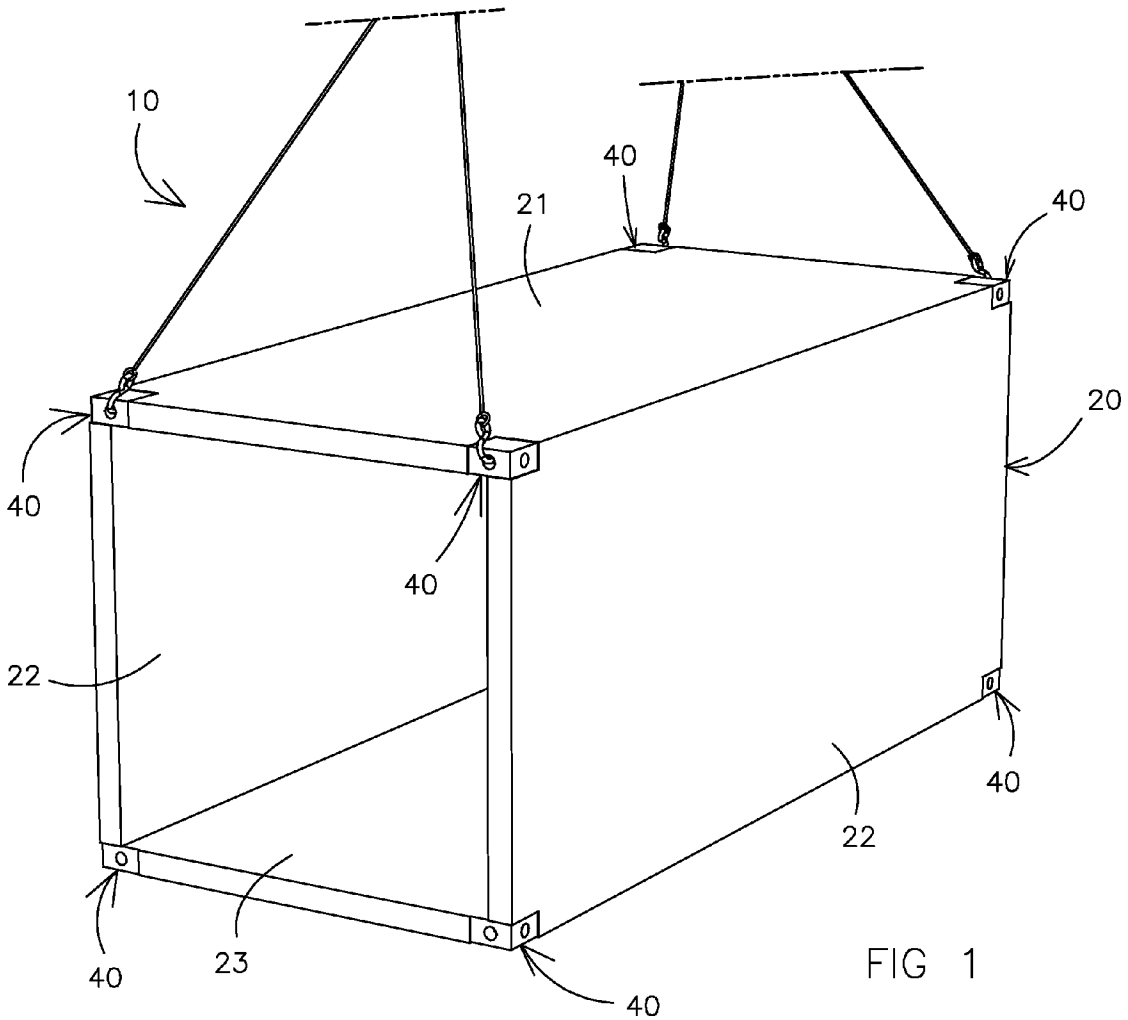
FIG. 1 represents an isometric view of the present invention being lifted by a crane through corner casting assemblies 40 mounted to four corners of top wall 21.
Figure 1A:
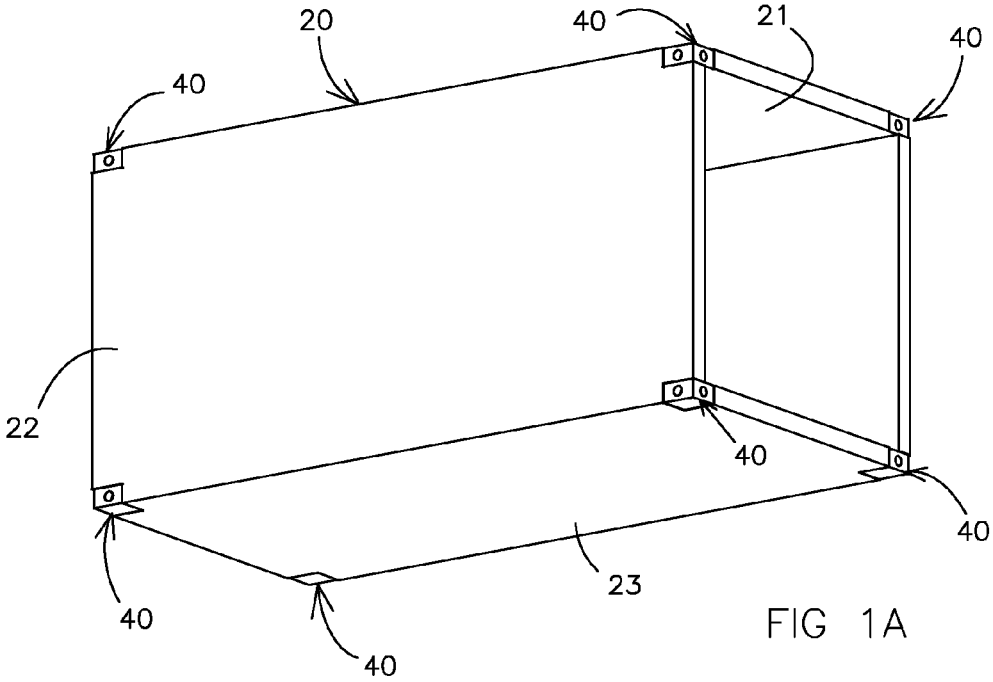
FIG. 1A shows a bottom isometric view of frame assembly 20 showing corner casting assemblies 40 mounted to the four corners of the former.
Figure 1B:
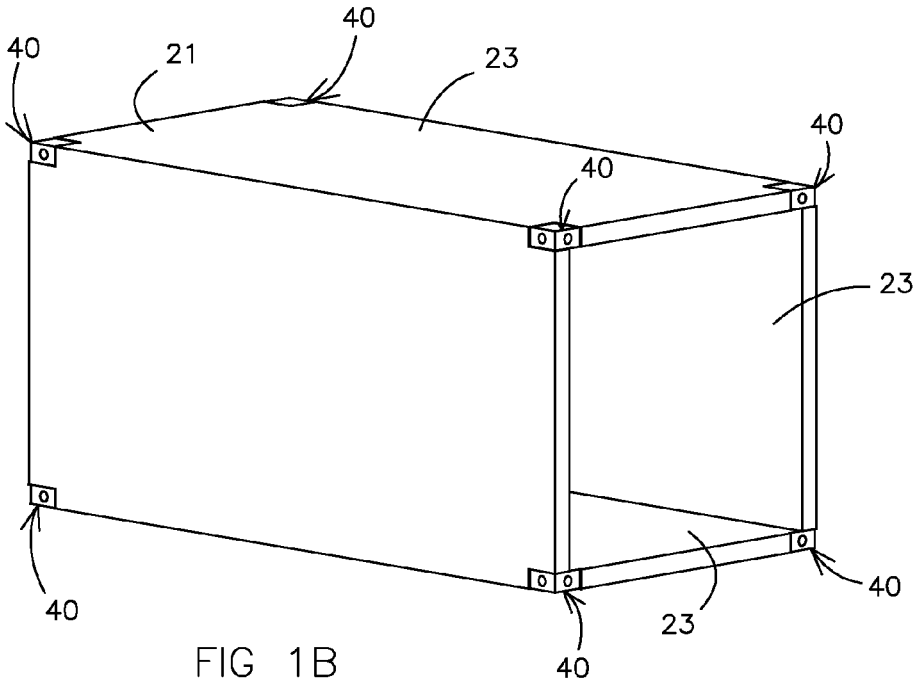
FIG. 1B shows an isometric view of frame assembly 20 showing corner casting assemblies 40 mounted thereon.

Referring now to the drawings, where the present invention is generally referred to with numeral 10, it can be observed that it basically includes box-like frame assembly 20, corner casting assemblies 40, and ring assembly 60.

As shown in FIG. 1, frame assembly 20 includes top wall 21, perimeter walls 22, and bottom wall 23 defining a box-like structure with one open face. Horizontal rebar beams 24 are longitudinally mounted to the top and bottom of each perimeter wall providing structural support for frame assembly 20. Rebar beams 24 are kept at a substantially parallel and spaced apart relationship by vertical rebar beams 25 which are perpendicularly mounted to horizontal rebar beams 24 through corner casting assemblies 40. The dimensions of beams can vary depending on the size of the concrete building unit used.

Figure 2:
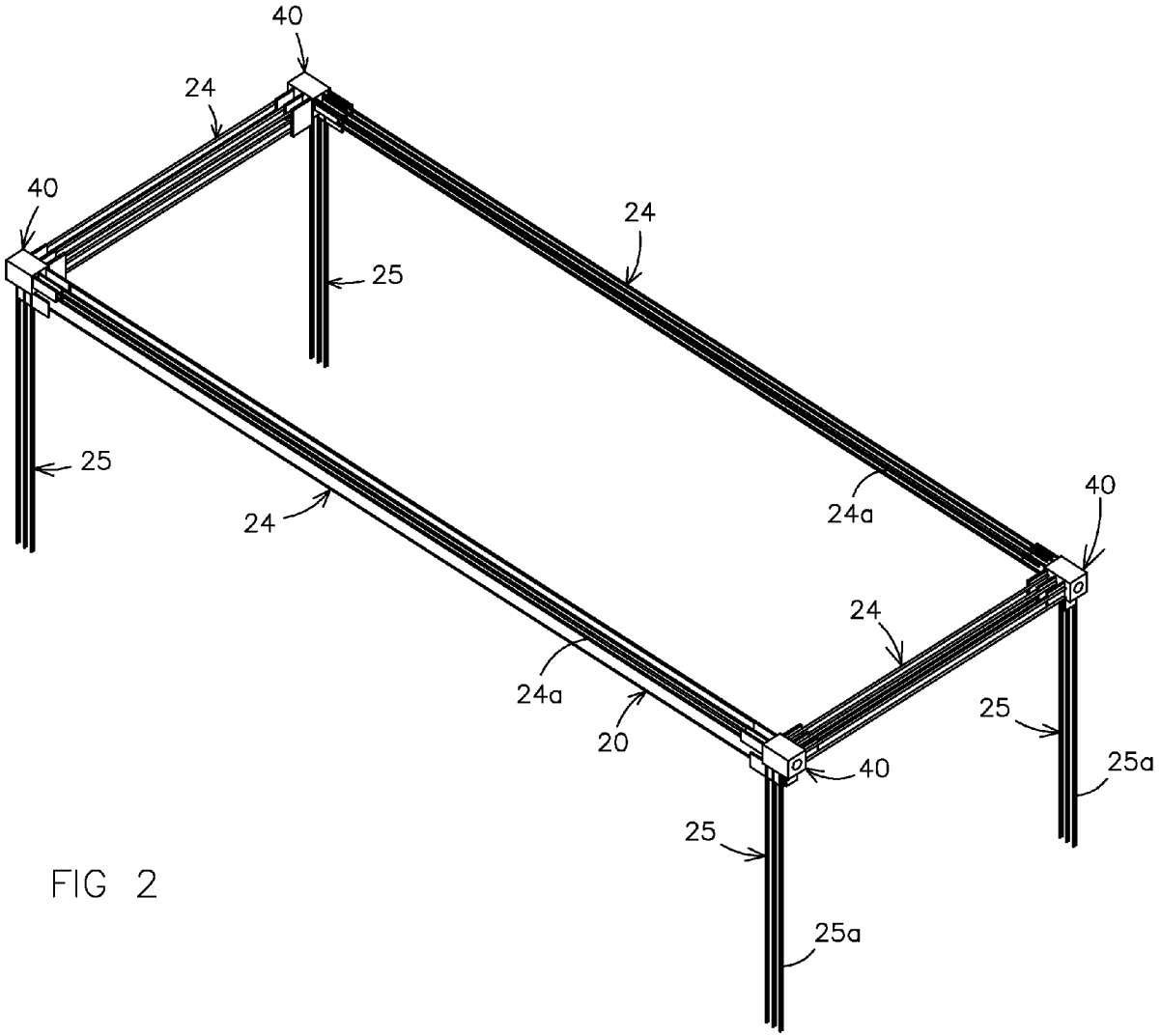
FIG. 2 shows an isometric view of corner casting assemblies 40 mounted to frame assembly 20 using horizontal and vertical beams 24; 25, respectively, composed of horizontal and vertical rebar members 24*a* and 25*a*, respectively.

As shown in FIG. 2, horizontal and vertical beams 24; 25, respectively, are composed of a plurality of rebar members 101*a* that attach to corner casting assemblies 40.

Figure 3:
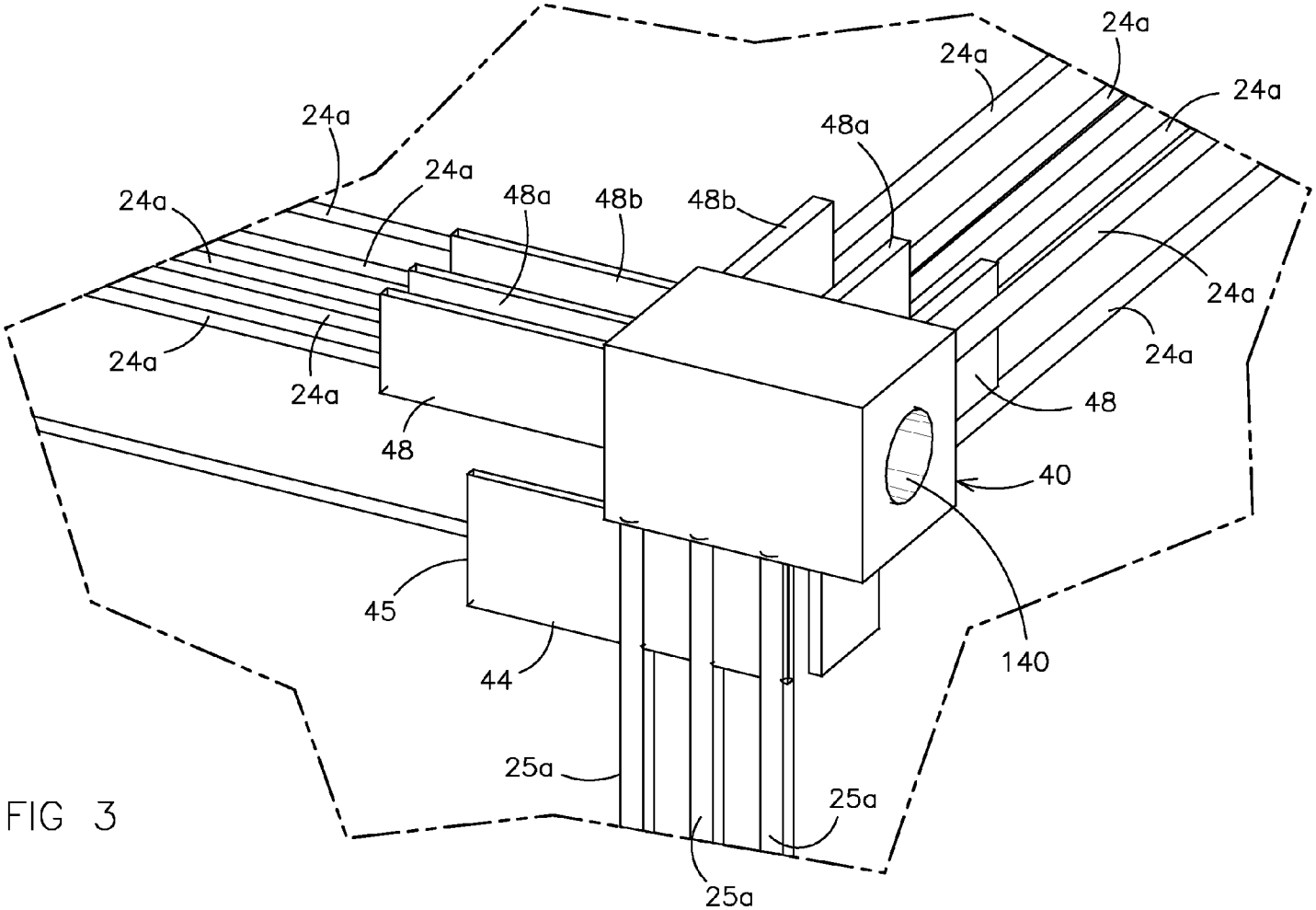
FIG. 3 illustrates a partial isometric inner view of corner casting assemblies 40 showing the connection between vertical and horizontal rebar members 25*a* and 24*a*, respectively, to first side plate 44 of corner casting assembly 40.
Figure 4:
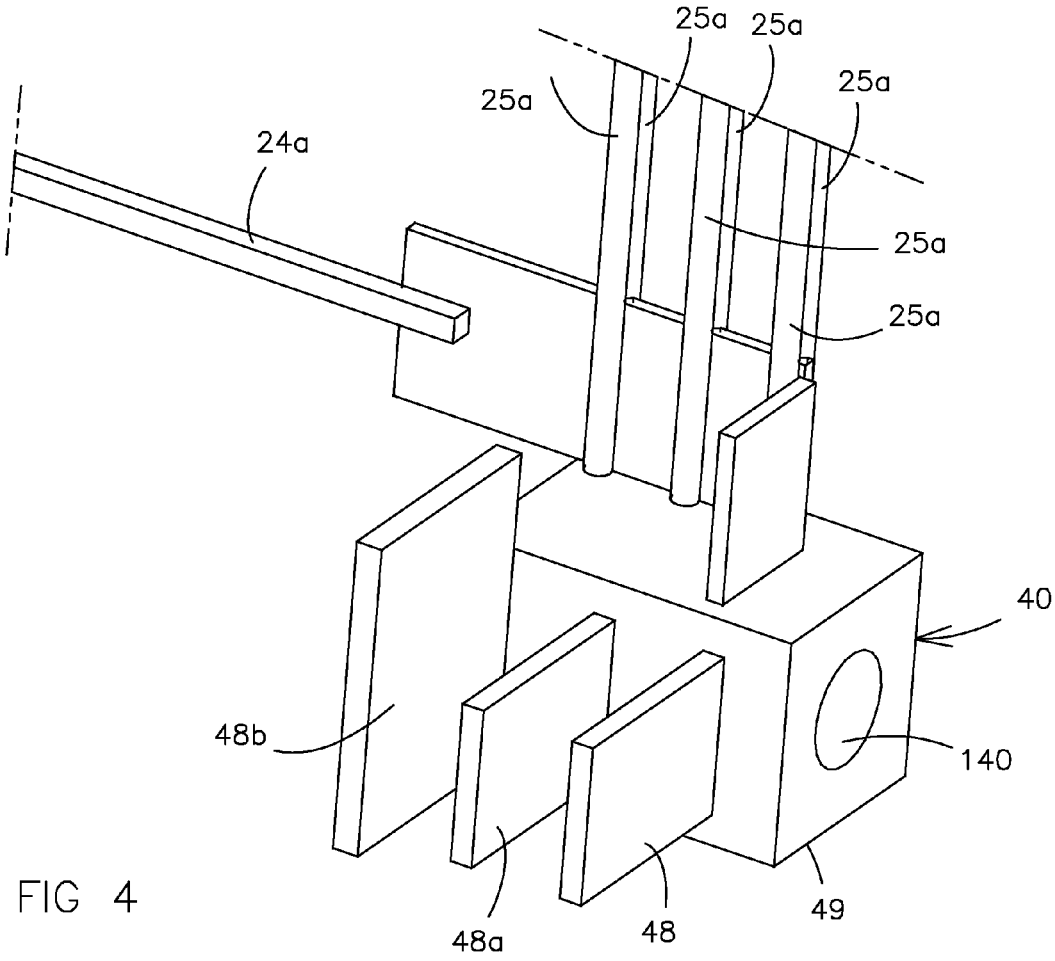
FIG. 4 shows an outside partial isometric outer view of the previous figure where corner casting assemblies 40 showing the connection between vertical and horizontal rebar members 25*a* and 24*a*, respectively, to first side plate 44 of corner casting assembly 40.

In one of the embodiments, and as seen in FIGS. 3 and 4, corner casting assemblies 40 include vertical plates 42 mounted to inner casting surface 43. Vertical plates 42 are mounted to a predetermined height of vertical rebar member 25*a* to provide a more secure attachment between vertical rebar member 25*a* and inner casting surface 43.

Corner casting assemblies 40 further include first side plate 44 adjacent and perpendicular to vertical plates 42, as seen in FIGS. 3 and 4. First side plate 44 passes through the channel between vertical rebar members 25*a*. The inner and outer surfaces of first side plate 44 are mounted to the vertical rebar members 25*a* located on either side of first side plate 44, thereby further securing vertical rebar members 25*a* to inner casting surface 43 of casting assemblies 40. First side plate 44 extends past inner casting surface 43 towards the length of frame assembly 20 to secure the remaining vertical rebar members 25*a* that are mounted to the concrete at the base of horizontal beam 24. First side plate 44 includes distal end 45 that is mounted to outer horizontal rebar members 24*a*. Frame assembly 20 also includes second side plate 46 mounted to first side face 47 of corner casting 40 and kept at a parallel and spaced apart distance to first side plate 44. Horizontal rebar members 24*a* are mounted to the outer and inner surfaces 46*a*; 46*b*, respectively, to attach horizontal rebar members 24*a* to corner casting assemblies 40.

As shown in FIGS. 3 and 4, in one of the embodiments, corner casting assemblies 40 also include third, fourth, and fifth side plates 48; 48*a*; 48*b*, respectively, at a spaced apart and substantially parallel relationship with respect to each other, and each mounted to second side face 49 of casting assemblies 40. The surface of third, fourth, and fifth side plates 48; 48*a*; 48*b* are mounted to horizontal rebar members

24*a* to provide a secure engagement between horizontal rebar members 24*a* of frame assembly 20 and corner casting assemblies 40.

As seen in FIG. 3, corner casting assembly 40 includes aperture 140 with compatible dimensions for conventional container transportation means, thereby allowing the concrete building unit subject of the present invention to be stacked, lifted, lowered, and otherwise transported. Corner casting assembly 40 is mounted to the corners of top wall 21 and bottom wall 23 so that aperture 140 is exposed.

Figure 5:
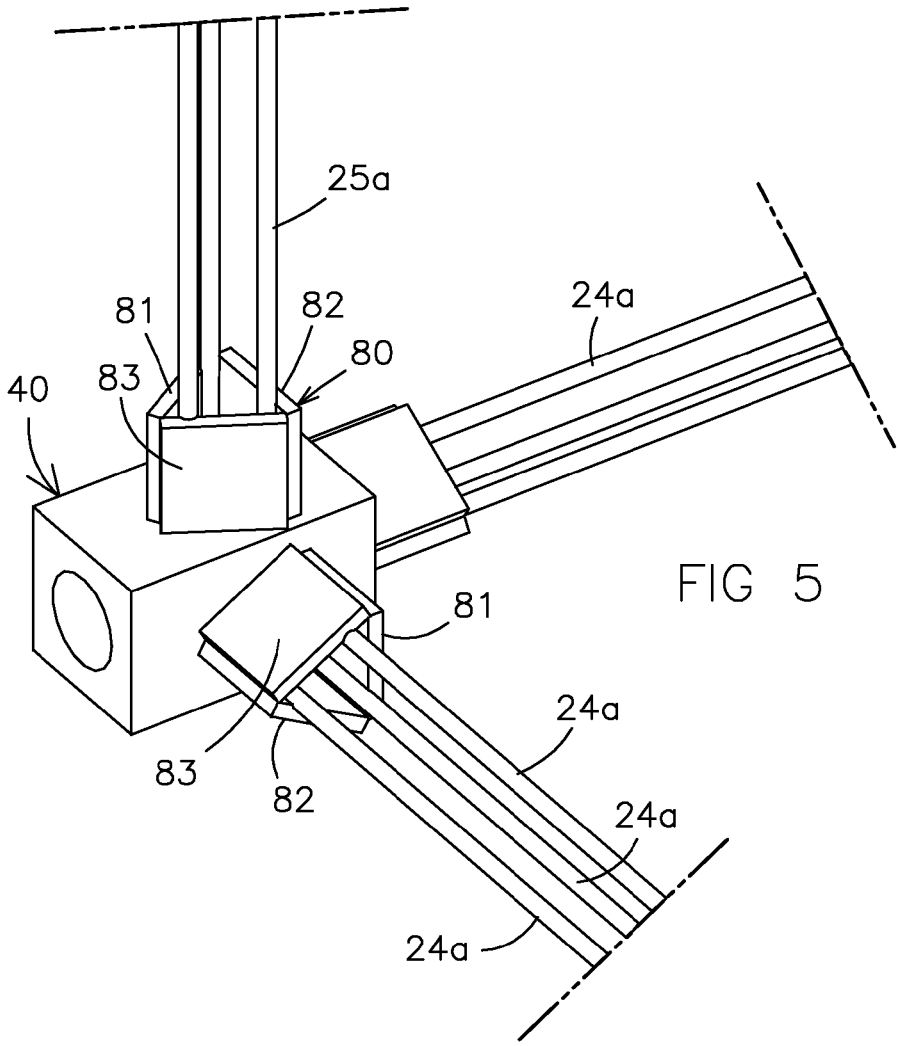
FIG. 5 represents a partial isometric view of an alternate embodiment using attachment plates 81, 82, 83 mounted together to form housing assembly 80 which is mounted to corner casting assemblies 40.
Figure 5A:
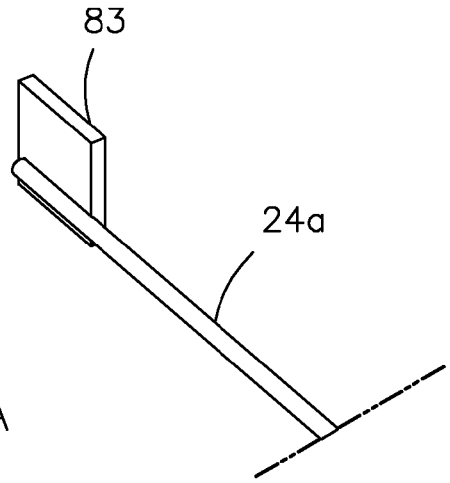
FIG. 5A illustrates a partial isometric view of the alternate embodiment in the previous figure showing rebar member 24*a* mounted to attachment plate 83.

In an alternate embodiment, shown in FIG. 5, corner casting assemblies 40 can be mounted to frame assembly 20 using housing assembly 80. Housing assembly 80 includes attachment plates 81; 82; 83 that each have a rebar member mounted to their respective inner surface 81*a*; 82*a*; 83*a*, respectively. Attachment plates 81; 82; 83 are then mounted to corner casting assembly 40 and to each other to form housing assembly 80.

Figure 6:
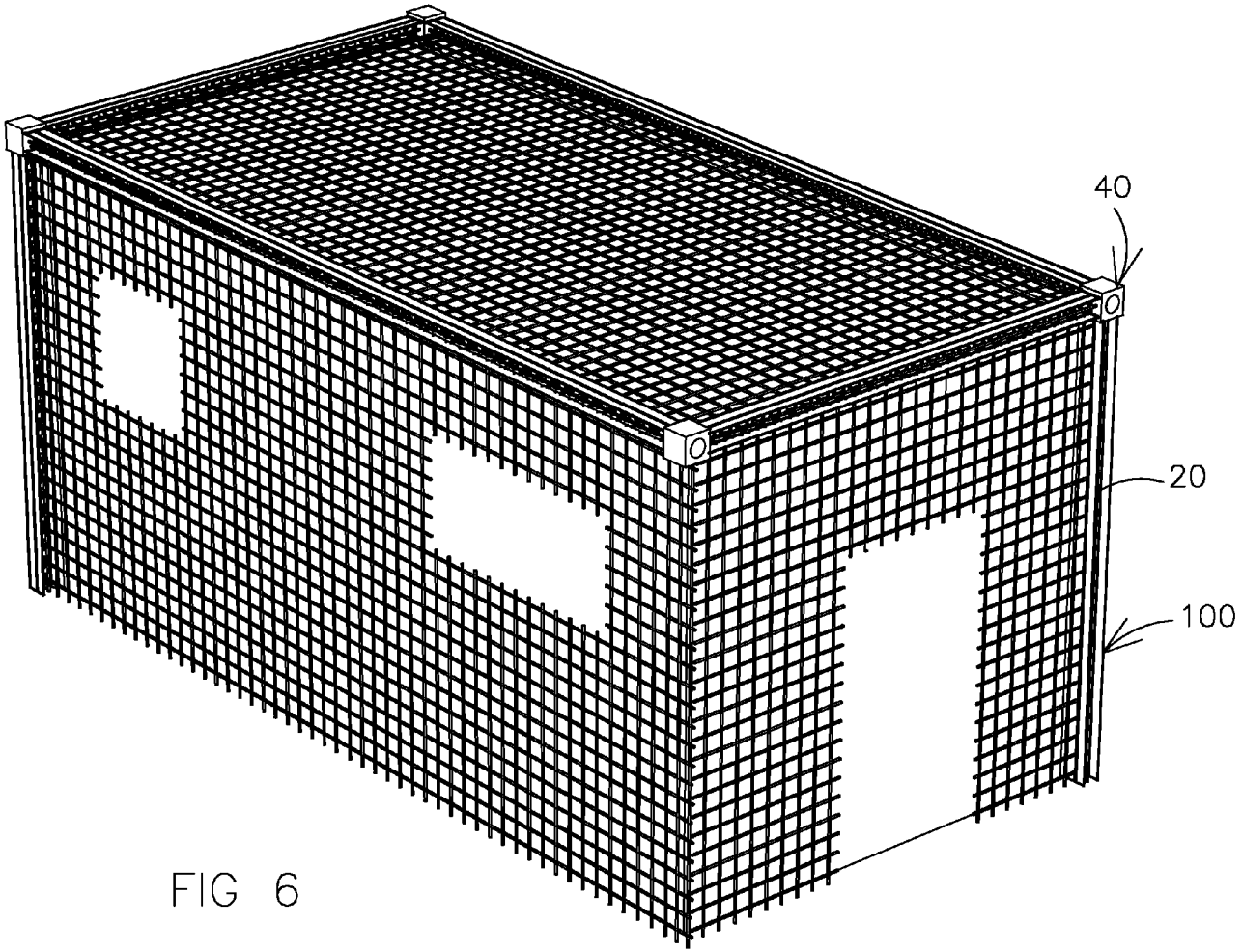
FIG. 6 is an isometric view of an alternate embodiment using I-beam assemblies 100 mounted to frame assembly 20 and corner casting assemblies 40.
Figure 6A:
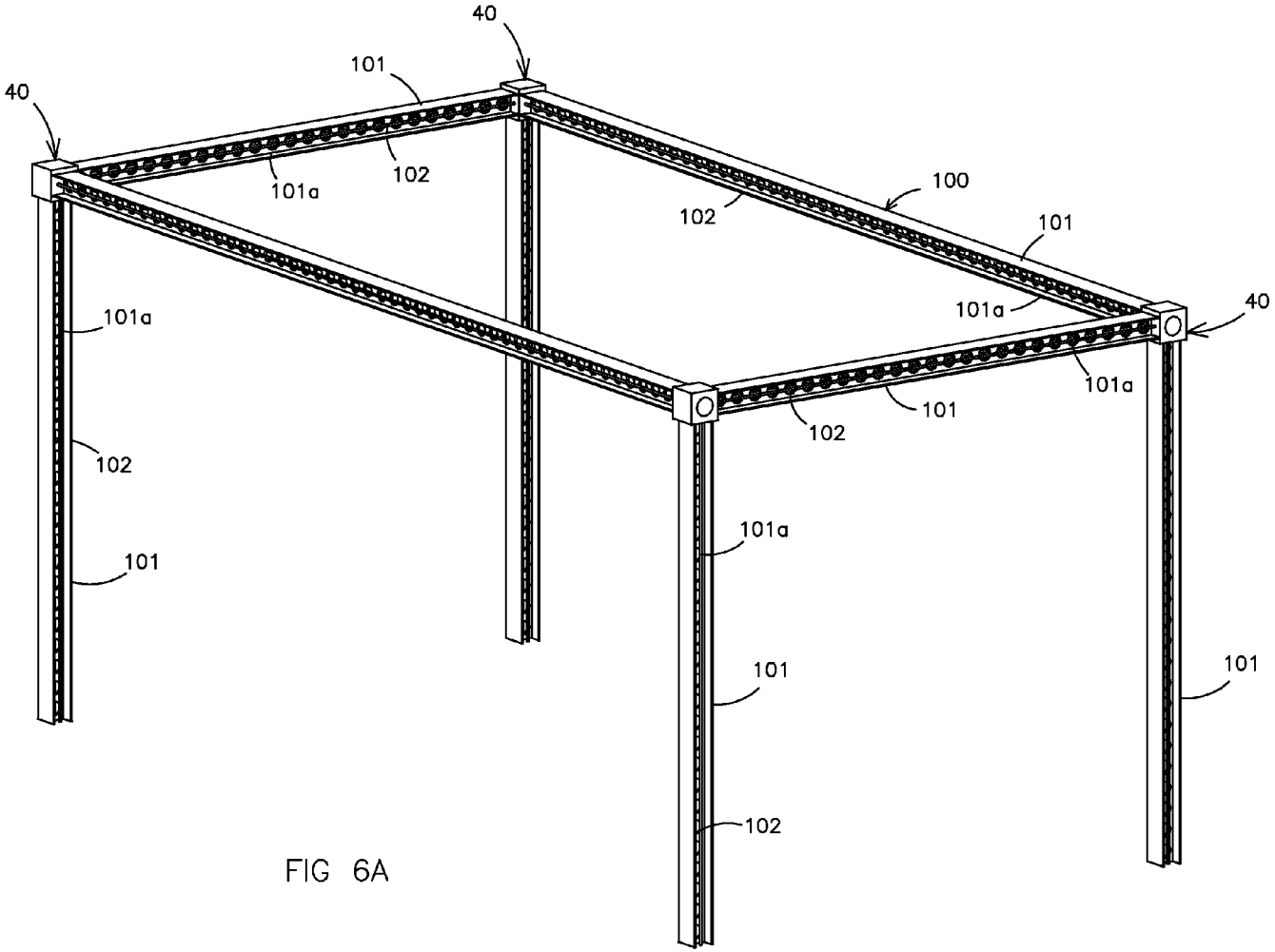
FIG. 6A shows an isometric view of the alternate embodiment in the previous figure where I-beam members 101 use throughholes 102 and rebar members 101*a* to secure I-beam assemblies 100 to frame assembly 20, not shown.

In yet another alternate embodiment, as shown in FIGS. 6 and 6*a*, corner casting assemblies 40 can be mounted to frame assembly 20 using I-beam assembly 100. I-beam assembly 100 includes I-beam member 101 including a plurality of throughholes 102. Throughholes 102 allow for concrete to pass through I-beam member 101 to create a more secure engagement between I-beam member 101 and the walls supported by frame assembly 20. Also, throughholes 102 are intended to reduce the weight of the structure without materially compromising its structural integrity. Optionally, I-beam assembly 100 can include rebar members 101*a* on either side of I-beam member 101 for enhanced securement.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pre-fabricated concrete intermodal building unit comprising a box-like frame defined by a top wall and a bottom wall, each with four corners, the top wall and bottom wall kept at a parallel and spaced apart relationship with respect to each other by two peripheral side walls, an open façade, and a peripheral end wall, said side walls being kept at a parallel and spaced apart relationship with respect to each other and said end wall being kept at a parallel and spaced apart relationship with respect to the open façade, said end wall being perpendicularly mounted to said side walls, said top and bottom walls including rebar members around their respective peripheries and each of said rebar members having at least one rebar member defining the perimeter of said top and bottom walls, said side walls having said rebar members travel horizontally throughout its top and bottom peripheries, a corner casting assembly for each of said corners, said corner casting assembly having an aperture facing outwardly to facilitate engagement with a compatible hook member for lifting said unit, each of said corner castings being rigidly mounted to the ends of said rebar members, using a plurality of support plates mounted to said corner casting assembly, said plurality of support plates are mounted to said rebar members of said frame assembly, said plurality of support plates are spaced apart a predetermined distance from each other and are of a substantially flat configuration having two open faces to permit a user to readily access the entire surface area of said faces to uniformly apply concrete.

2. The building unit of claim 1, wherein said plurality of support plates comprise two support plates that are in the vertical position.

3. The building unit of claim 1, wherein said plurality of support plates comprise three support plates that are in the horizontal position.

* * * * *